United States Patent [19]

Reese et al.

[11] 3,952,178

[45] Apr. 20, 1976

[54] SWITCH CONSTRUCTION

[75] Inventors: Cleve Lloyd Reese, Arden, N.C.; John P. Kelly, Mequon, Wis.

[73] Assignee: Square D Company, Park Ridge, Ill.

[22] Filed: Mar. 25, 1975

[21] Appl. No.: 561,684

[52] U.S. Cl. ..... 200/47
[51] Int. Cl.[2] ..... H01H 9/02
[58] Field of Search ..... 200/47

[56] References Cited

UNITED STATES PATENTS 3,578,932 5/1971 Holmes ..... 200/47 X

*Primary Examiner*—Herman J. Hohauser
*Attorney, Agent, or Firm*—Neuman, Williams, Anderson & Olson

[57] ABSTRACT

A limit switch construction is provided in which a first component is affixed to a first section of a housing and a second component is affixed to a second section of the housing. When the two sections of the housing are assembled, the components electrically engage one another and are encompassed by the housing. The first component includes a pair of stationary contact means and a third contact means selectively movable into electrical contact with either of said stationary contact means. The second component is provided with a plurality of terminals which are electrically connected to corresponding contact means of the first component when the housing sections are assembled. The contact means and terminals are located adjacent one of the side walls of the first and the second sections and the second housing section is provided with an elongated pocket for accommodating portions of the electrical leads extending into the housing and connected to the terminals.

10 Claims, 7 Drawing Figures

FIG. 1
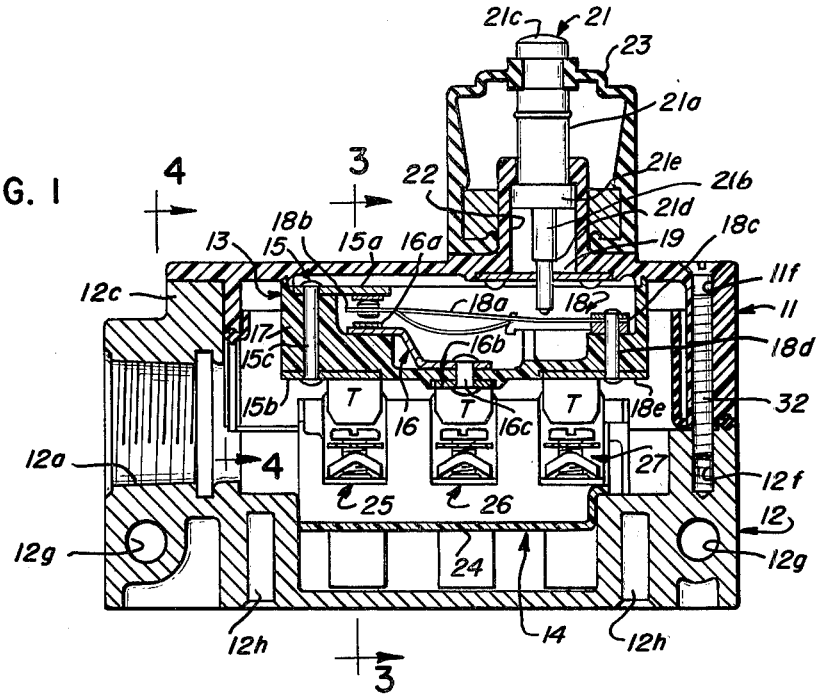
FIG. 2
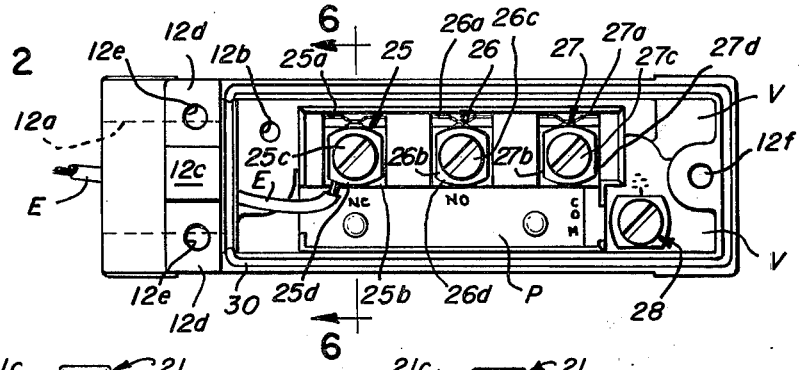
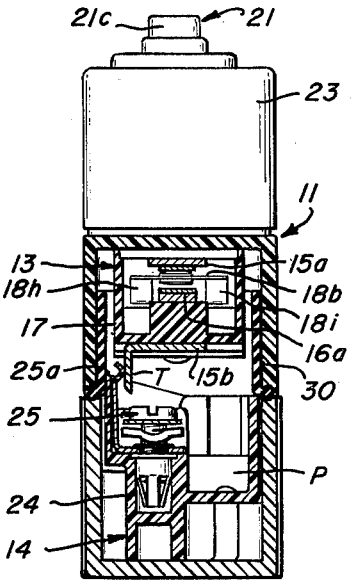
FIG. 3
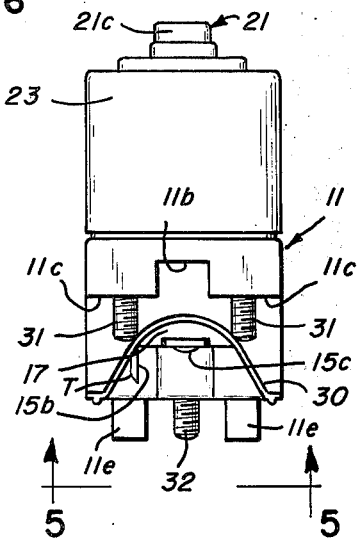
FIG. 4

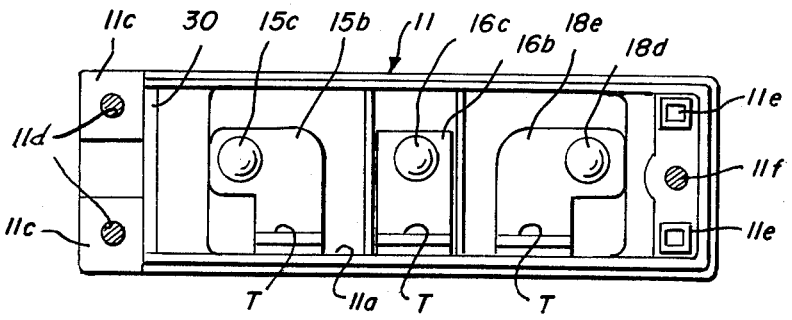
FIG. 5
FIG. 6
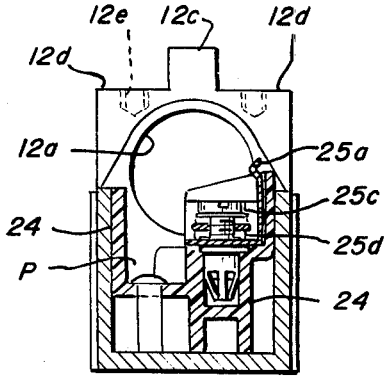
FIG. 7
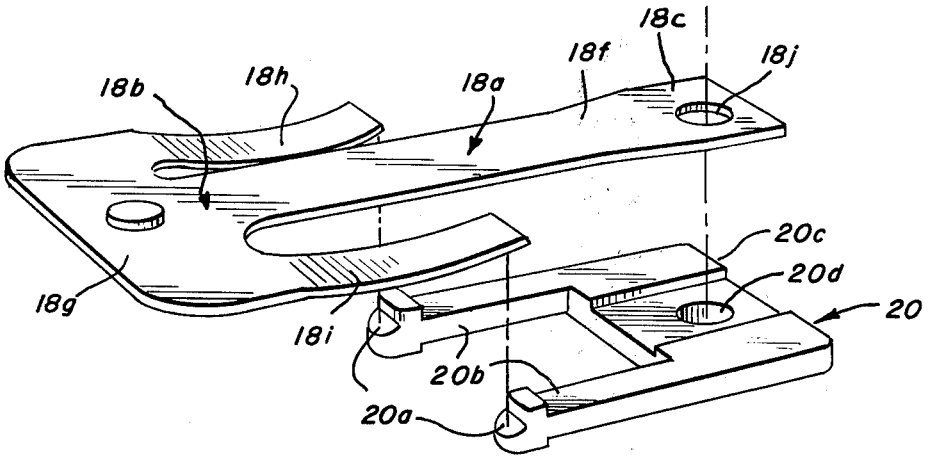

SWITCH CONSTRUCTION

BACKGROUND OF THE INVENTION

Switching devices such as limit switches are well known and frequently used in industry to detect the position of various moving parts of a machine and/or the presence or absence of a particular piece at a predetermined station during a cycle of operation of the machine. A typical limit switch used for such purpose is a plug-in type such as disclosed in U.S. Patent Re. No. 27,016, Basically, such a switch is of a heavy duty variety with substantial current-switching capabilities and is intended primarily to be used on machine tools or in similar demanding applications.

Recent changes have occurred in various electrical codes in the United States as well as in foreign countries which dictate that a single connection between the metal conduit carrying the wires to the switch and the switch housing no longer satisfies the requirements for proper grounding. Thus, it has been found where a particular application requires a light-duty, compact, plug-in type limit switch that compliance with the code grounding requirements becomes difficult to attain and oftentimes causes the installation and servicing of such a switch to be an awkward and frustrating manipulation requiring inordinate dexterity on the part of the installer or service personnel.

SUMMARY OF THE INVENTION

Thus, it is an object of the invention to provide a compact, inexpensive limit switch which is easy to wire and service.

It is a further object of the invention to provide a compact, light-duty limit switch which provides adequate space within the housing to readily accommodate wiring without causing same to be subjected to abnormal distortion.

It is a still further object of the invention to provide a limit switch which is capable of readily meeting both the United States and foreign electrical codes.

Further and additional objects will appear from the description, accompanying drawings and appended claims.

In accordance with one embodiment of the invention, a limit switch of a plug-in type is provided which includes first and second components. The first component is affixed to a first section of a housing, and the second component is affixed to a second section of the housing. When the housing sections are assembled, the first and second components will make electrical contact with one another and be enclosed within the housing. The first component is provided with a switch having stationary first and second contact means arranged in spaced relation, and a third contact means having a portion thereof disposed intermediate said first and second contact means and selectively movable into electrical contact with either the first or second contact means. An actuating element is carried by the housing first section to effect selective movement of the third contact means portion. The second component is provided with a plurality of terminals having first segments adapted to electrically engage corresponding segments of the contact means of the first component when the housing sections are assembled. The terminals include second segments to which the electrical leads are connected. The second component is provided with a pocket for accommodating portions of the electrical leads. The pocket is disposed between and adjacent to the terminal second segments and a first interior wall surface of the housing. All of the electrically engaged segments of the first and second components are disposed adjacent a second interior wall surface of the housing which is opposite the first interior wall surface.

DESCRIPTION

For a more complete understanding of the invention, reference should be made to the drawings wherein:

FIG. 1 is a vertical sectional view of one form of the improved limit switch showing the housing sections in assembled relation.

FIG. 2 is a top plan view of the housing second section when the housing first section is removed therefrom.

FIG. 3 is a sectional view taken along line 3—3 of FIG. 1.

FIG. 4 is an end view of the housing first section taken along line 4—4 of FIG. 1.

FIG. 5 is a bottom view of the housing first section taken along line 5—5 of FIG. 4.

FIG. 6 is a sectional view of the housing second section taken along line 6-6 of FIG. 2.

FIG. 7 is an enlarged perspective, exploded view of the third contact means and a mounting bracket therefor forming parts of the first component mounted on the housing first section.

Referring now to the drawings and more particularly to FIG. 1, one form of an improved plug-in type limit switch 10 is shown which is especially suitable for a light duty operation. The switch 10 includes a pair of complemental housing sections 11 and 12 which are adapted to interfit with one another so as to enclose the various components 13 and 14 to be hereafter described. Housing section 11 is preferably a molded piece formed of a suitable plastic material having desirable electrical insulating characteristics. Housing section 12, on the other hand, may be formed from metallic material. Affixed to the interior of housing section 11 is a first component 13 which includes first and second contact means 15 and 16 affixed in spaced relation on a mounting member 17 of suitable electrical insulating material. Contact means 15 includes a contact piece **15*a*, a blade-like piece 15*b* and a metallic rivet 15*c* interconnecting the two pieces. Contact means 16 in a similar manner includes a contact piece 16*a*, a blade-like piece 16*b* and an interconnecting metallic rivet 16*c***.

A third contact means 18 is also mounted on member 17 and includes an elongated contact piece **18*a* which has an end portion 18*b* disposed between contact pieces 15*a* and 16*a* and selectively movable relative thereto into electrical contact with either piece 15*a* or piece 16*a*. The opposite end portion 18*c* of piece 18*a* is connected by a metallic rivet 18*d* to a blade-like piece 18*e*. Rivet 18*d* also connects the end portion 18*c* to a bracket 20. Contact piece 18*a* and the bracket 20 are seen more clearly in FIG. 7.**

Contact piece **18*a* is preferably formed of spring metal and includes an elongated central arm portion 18*f* having the free end 18*b* thereof terminating in a cross portion 18*g*. Projecting from opposite ends of portion 18*g* are a pair of spring fingers 18*h* and *i*. Fingers 18*h* and *i* are shorter than the central arm portion 18*f* and are adapted to resiliently engage the notched ends 20*a* of a pair of corresponding inflexible legs 20*b*** forming a part of bracket 20. When the contact piece 18*a* and bracket 20 are assembled, the fingers 18*h* and *i* will assume similar bowed configurations resulting in the free end portion 18*b* of the contact piece being biased so as to normally assume a position, as seen in FIG. 1, wherein contact means 15 and 18 are in electrical contact with one another.

Each blade-like piece 15*b*, 16*b* and 18*e* is provided with a similar depending blade or tongue T. The tongues are arranged in aligned spaced relation and adjacent the interior surface of one depending wall 11*a* of the housing section 11.

In the illustrated switch 10, an elongated plunger 21 is provided on housing section 11 which is adapted to coact with the central arm 18*f* of the contact piece to effect relative movement of the free end 18*b* thereof from its normal position of contact with contact piece 15*a* to a position of contact with contact piece 16*a*. Plunger 21 is provided with a pair of telescoping sections 21*a* and 21*b* which are normally maintained in extended positions by a concealed spring, not shown. After section 21*b* has moved in a downward direction the required distance, it will stop because of a shoulder 21*d* thereof engaging a stop plate 19 and then the concealed spring will absorb any excessive, external, compressive force manually or otherwise applied to the projecting end 21*c* of telescoping section 21*a* and thus prevents the central arm 18*f* becoming damaged by such force. Plunger section 21*a* is provided with an external collar 21*e* which is slidably disposed within and guides the movement of the plunger section within a cylindrical transverse bore 22 formed in the housing section 11. Encompassing plunger section 21*a*, except for end 21*c*, is a resilient inverted cup-shaped boot 23 which is suitably secured to the housing section 11. The inherent resiliency of the boot may be sufficient to cause the plunger 21 to normally assume a non-depressed position, as seen in FIG. 1. If desired, however, a separate spring, not shown, may be provided for the plunger to supplement the force of the boot in returning the plunger 21 to its non-depressed position. When the plunger 21 is depressed, the boot 23 will become distorted as required and thus will not obstruct movement of the plunger.

Bracket 20, as seen in FIG. 7, has a substantially U-shape with the legs 20*b* thereof being interconnected by a bail portion 20*c*. Portion 20*c* is provided with a suitable opening 20*d* which is aligned with an opening 18*j* formed in contact arm 18*f* to receive the shank of rivet 18*d*.

Affixed to the interior of housing section 12 is the second component 14 which includes a mounting member 24 of insulating material to which a plurality of terminals 25, 26 and 27 are attached. The number of terminals carried on mounting member 24 corresponds to the number of contact means comprising component 13. Each terminal includes a resilient finger portion 25*a*, 26*a* and 27*a* which is adapted to be slidably engaged by the tongue of the corresponding blade-like piece 15*b*, 16*b* or 18*e* when the housing sections 11 and 12 are assembled as seen in FIG. 1. In addition to a finger portion, each terminal includes a second portion 25*b*, *26b* or 27*b* to which an electrical lead or wire E is connected, see FIG. 2. The second portions of the terminals are arranged in longitudinally spaced relation and are suitably secured to the mounting member 24, see FIGS. 1 and 2. In the illustrated embodiment, each second portion of the terminal includes a tightening screw 25*c*, 26*c* or 27*c* having a lock washer carried on the underside of the screw head, and a wire clamp 25*d*, 26*d or 27d*. The wire clamp cooperates with a surface portion of the terminal disposed therebeneath to clamp the end of an electrial lead therebetween and make electrical contact.

It will be noted in FIGS. 1, 2 and 3 that the mounting member 24 is provided with an elongated open top pocket or well P which is disposed adjacent the terminal portions 25*b*, 26*b* and 27*b*. The pocket P is of such dimension that it will readily accommodate portions of the leads disposed within the switch housing and thus facilitate connecting or disconnecting the leads with respect to the switch terminals. The location of the pocket is such that abnormal distortion of the leads E is not required in order to effect connection of the lead end to the terminal portion 25*b*, 26*b* or 27*b*. When the housing section 11 is disassembled from section 12, as seen in FIG. 2, the switch is inoperative and the heads of the tightening screws 25*c*, 26*c* and 27*c* are all readily accessible and may be easily adjusted by the tip of a conventional screwdriver. Furthermore, the pocket P is spaced a substantial distance from the terminal finger portions, thereby avoiding interference by the electrical leads E with the sliding engagement between the tongues T of the first component 13 with the terminal finger portions of the second component when the housing sections 11 and 12 are assembled.

Housing section 12 is provided with an internally threaded passageway or opening 12*a* disposed at one end of the pocket P. The passageway enables electrical leads to be inserted into the housing interior and the internal threading is adapted to accommodate a conduit connector or the like when the switch is installed.

In addition to terminals 25, 26 and 27, there is a ground terminal 28 which, as shown in FIG. 2, is disposed adjacent the end of pocket P remote from the passageway 12*a*. In certain instances and to satisfy certain foreign code requirements, it is preferred to have the ground terminal 28 disposed adjacent said passageway, in which case a threaded opening 12*b* is provided in the housing section 12 to receive the threaded shank of the tightening screw 28*a* of the terminal 28.

A sealing gasket 30 of resilient insulating material is provided for disposition between the mating surfaces of the housing sections forming the interior of the housing in which components 13 and 14 are disposed. Preferably the gasket 30 is carried by housing section 11 and may be affixed thereto by suitable adhesive.

In order to assure proper alignment of the housing sections when they are assembled, housing section 12 is provided with an upwardly extending boss 12*c* which is positioned adjacent the end of the housing section in which the passageway 12*a* is formed. The boss has a substantially rectangular configuration and the surface portions 12*d* of the housing section disposed on opposite sides of the boss are substantially planar and each portion is provided with a threaded hole 12e.

Housing section 11 has formed at one end thereof a recess 11*b* which is sized and shaped so as to slidably receive the boss 12*c* of housing section 12. The surface portions 11*c* on opposite sides of recess 11*b* are substantially planar so as to properly mate with the corresponding surface portions 12*d* of the housing section 12. Each surface portion 11*c* is provided with an opening 11*d* to receive the shank of an assembly screw 31, see FIGS. 4 and 5. The upper end of each opening may be countersunk to accommodate the head of the screw 31. The end of housing section 11, opposite the end having recess 11*b*, is provided with a pair of depending lugs 11*e*, see FIGS. 4 and 5. The lugs are in spaced relation and are disposed in close proximity to corresponding corners of the section 11. When the housing sections are assembled, the lugs 11*e* will slidably fit into voids V formed at the interior corners of housing section 12, see FIG. 2. Located between lugs 11*e* is an opening 11*f* which is adapted to accommodate a third assembly screw 32. As in the case of openings 11*d*, the upper end of opening 11*f* may be countersunk to accommodate the head of screw 32.

The inner end of screw 32 is threaded into an aligned opening 12*f* formed in housing section 12, see FIGS. 1 and 2. Thus, when the housing sections are in assembled relation, they are positively retained in such relation by assembly screws 31 and 32. The relative locations of the screws are such that they do not interfere with the slidable contact between the tongues T and the terminal finger portions, or with the connection between the electrical leads and the terminals 25, 26, 27 and 28.

Housing section 12 is provided with pairs of openings 12*g* and 12*h* to enable the section to be fixedly mounted on an upright or horizontal supporting surface, not shown, by suitable fasteners.

Thus, it will be seen that a limit switch has been provided which is of sturdy, compact construction; is simple to assemble and disassemble; provides ample space to facilitate connecting of the electrical leads to the switch terminals; enables the electrical leads to be readily accommodated within the housing interior without causing the leads to be abnormally distorted or obstructing the sliding engagement between portions of the switch components when the housing sections are assembled; is capable of readily meeting both foreign and domestic electrical code requirements; and the housing section 11 may be removed for servicing or replacement without requiring housing section 12 being disconnected from the electrical leads.

It is to be understood that the size and shape of the housing sections and components therefor; the location and configuration of the plunger assembly; and the number of contact means may be varied from that shown and described without departing from the scope of the invention.

We claim:

1. An electrical switch comprising a first component, a second component removably assembled with said first component, and a housing substantially enclosing said assembled components, said housing having a first section on which said first component is fixedly mounted and a second section on which said second component is fixedly mounted, said housing being provided with a passageway for electrical leads extending into the housing interior; said first component including first and second contact means arranged in spaced relation, and a third contact means having a portion thereof disposed intermediate said first and second contact means and being selectively movable into electrical contact with either the first or second contact means, each of said contact means being provided with a protuberance adapted to slidably engage in electrical contact a corresponding protuberance formed on said second component when said components are in assembled relation, said first component being provided with an adjustable actuating element to effect selective movement of said third contact means portion, adjustment of said element being effected exteriorly of said housing; the protuberances formed on said second component forming first segments of a plurality of terminals, said terminals having second segments spaced from said first portions for connection to the electrical leads when said housing sections are disposed in disassembled relation, said terminal second segments being spaced from a first interior wall surface of the housing, said housing second section having a pocket formed therein and in communication with said passageway for accommodating portions of the electrical leads extending into the housing interior, said pocket being disposed adjacent said terminal second segments and spaced from said terminal first segments.

2. The electrical switch of claim 1 wherein the portion of said third contact means disposed intermediate said first and second contact means is biased so as to normally assume electrical contact with said first contact means.

3. The electrical switch of claim 2 wherein the adjustable actuating element of said first component comprises a plunger having one end thereof protruding outwardly from the housing and an opposite end thereof concealed within the housing and adapted to engage said third contact means and overcome the bias exerted on the portion thereof so as to break the electrical contact with said first contact means and effect electrical contact between said portion and said second contact means, only when a predetermined external force is applied to said plunger one end.

4. The electrical switch of claim 1 wherein said housing second section is provided with a ground terminal spaced from said aforementioned terminals and disposed adjacent said pocket.

5. The electrical switch of claim 1 wherein said housing has an elongated configuration and the protuberances of said first and second components are arranged in aligned spaced relation adjacent an elongated first interior wall surface of said housing, and the pocket is disposed adjacent an opposite elongated second interior wall surface.

6. The electrical switch of claim 5 wherein the pocket has an elongated bottom surface recessed relative to the second segments of said terminals.

7. The electrical switch of claim 6 wherein the housing passageway is disposed adjacent one end of said pocket; said housing second section is provided with a ground terminal disposed adjacent one end of said pocket.

8. The electrical switch of claim 1 wherein an insulated gasket is interposed the assembled housing sections.

9. The electrical switch of claim 1 wherein the contact means of said first component are mounted on an insulated first member carried by said housing first section, and the terminals of said second component are mounted on an insulated second member carried by said housing second section.

10. The electrical switch of claim 3 wherein said plunger effects movement of said third contact portion from said first contact means to said second contact means when said plunger is depressed by a predetermined external force being applied thereto, said plunger normally assuming a non-depressed condition when the external force is removed.

* * * * *